United States Patent [19]

Brown

[11] 4,154,233

[45] May 15, 1979

[54] HUMAN SUPPORT APPARATUS

[76] Inventor: James E. Brown, P.O. Box 28574, Sacramento, Calif. 95828

[21] Appl. No.: 823,727

[22] Filed: Aug. 11, 1977

[51] Int. Cl.[2] ..... A61H 1/02

[52] U.S. Cl. ..... 128/75

[58] Field of Search ..... 128/24 R, 68, 75; 272/61, 24, 900, 62

[56] References Cited

U.S. PATENT DOCUMENTS

| | | | |
|---|---|---|---|
| 1,693,810 | 12/1928 | Daniels et al. | 128/70 |
| 2,838,307 | 6/1958 | Drew | 272/61 |
| 3,380,447 | 4/1968 | Martin | 128/75 |
| 3,593,708 | 7/1971 | Steele | 128/75 |
| 3,874,375 | 4/1975 | Penner | 128/75 |
| 3,876,199 | 4/1975 | Eichenauer | 272/62 |
| 3,984,101 | 10/1976 | Garza | 272/144 |

*Primary Examiner*—Lawrence W. Trapp
*Attorney, Agent, or Firm*—Ernest L. Brown

[57] ABSTRACT

Apparatus for supporting humans in a vertical head-down position, including apparatus for climbing into position.

16 Claims, 12 Drawing Figures

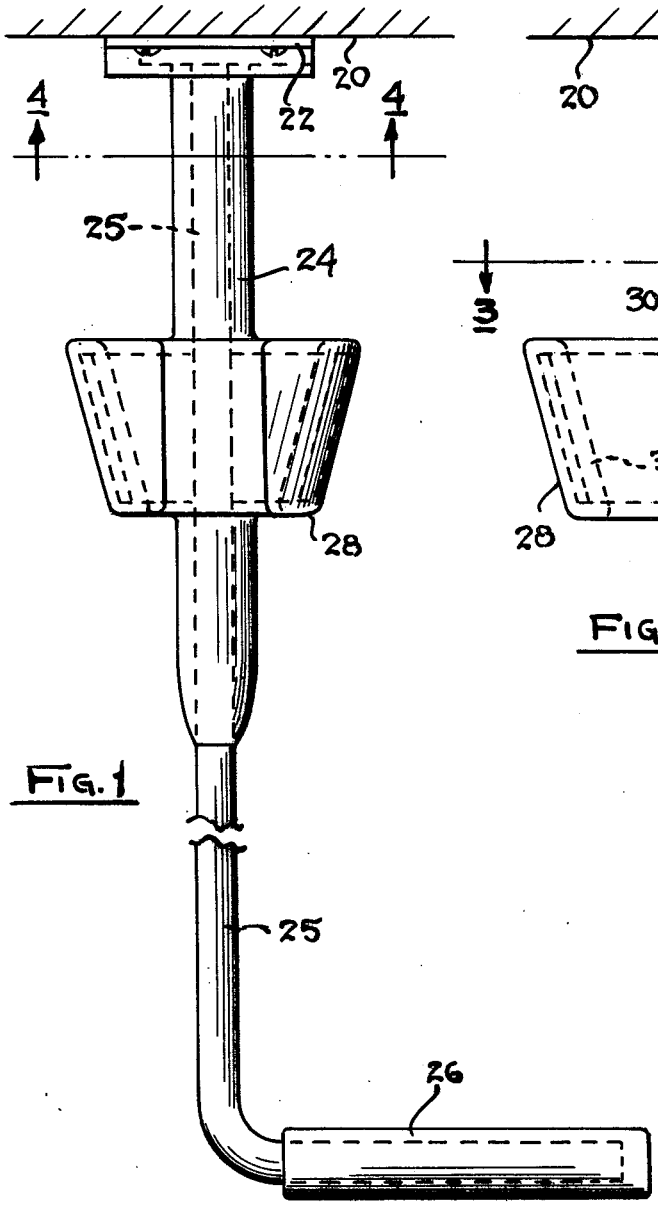
FIG. 1
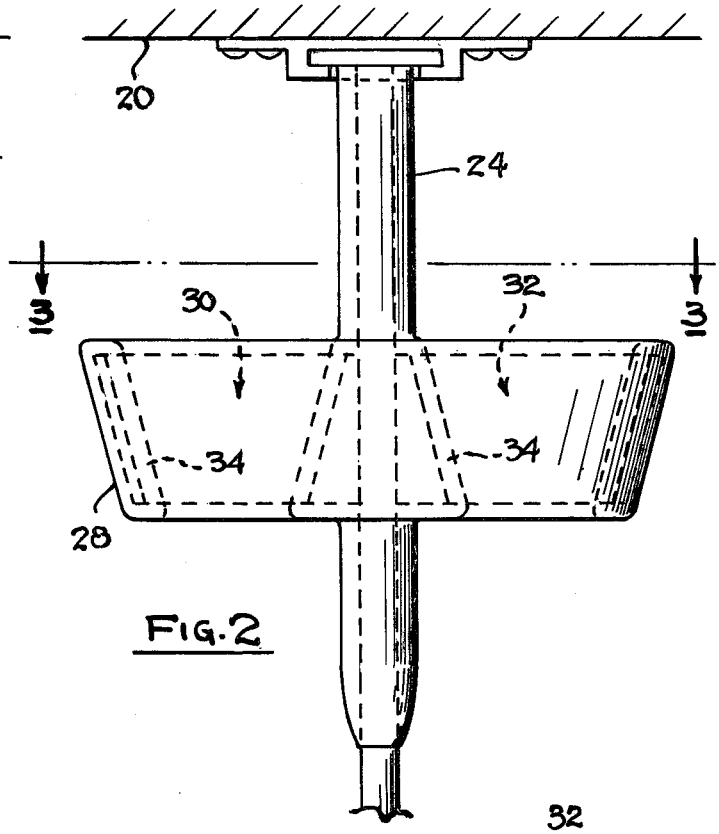
FIG. 2
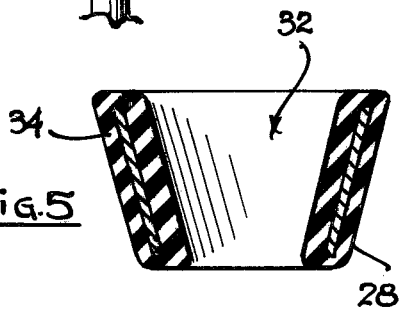
FIG. 5
FIG. 4
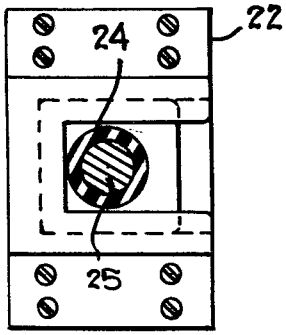
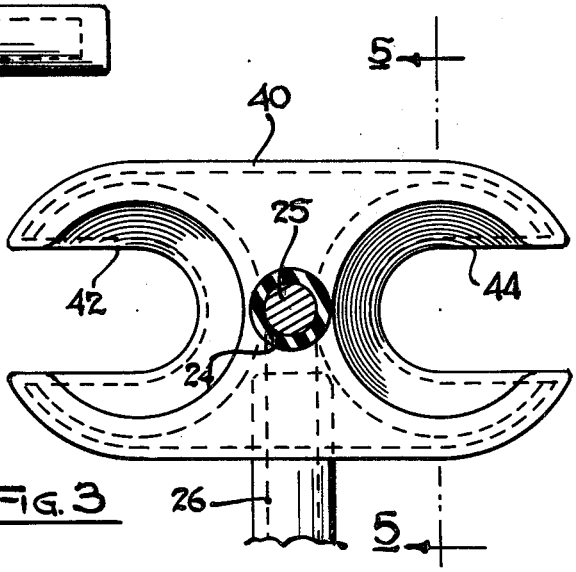
FIG. 3

HUMAN SUPPORT APPARATUS

BACKGROUND OF THE INVENTION

It is frequently desirable, for health and exercise reasons, to suspend a person in a head-downward but substantially vertical position.

U.S. Pat. No. 3,380,447 to Martin teaches an ankle device for supporting an individual in an inverted position.

U.S. Pat. No. 3,593,708 to Steele shows an apparatus for suspending a human being in an upside down, generally bent over, position.

U.S. Pat. No. 3,874,375 shows an exercise apparatus for suspending a person in an upside down position using a trapeze bar to assist the user in getting into position. A horizontal knee bar supports the person in an upside down position, and a second bar is used to trap the feet and to hold the person in the upside down position.

U.S. Pat. No. 3,081,085 to De Girolamo shows a back posture and stretch board for supporting a person in a substantially upside down position.

The shown apparatus, however, differs in structure from the apparatus contemplated by this invention.

BRIEF SUMMARY OF THE INVENTION

The apparatus contemplated by this invention is a padded structure shaped and contoured to support the feet of the user. In one embodiment, the support structure hangs from a ceiling bracket. In a second embodiment, the support structure hangs from a cross bar which, in turn, is supported by a pair of upright poles wedged between the ceiling and the floor.

One embodiment of the apparatus for assisting the user to raise himself is a downwardly extending pole from the foot support apparatus, the pole terminating in a substantially horizontal handle.

In a second embodiment of the apparatus for lifting ones self into the foot support, a rod or chain is suspended from the ceiling adjacent the foot support, and that rod or chain terminates in a hook or ring member.

In still a third embodiment of the apparatus for lifting ones self into the foot support, a rod or chain is suspended from the ceiling adjacent the foot support, and that rod or chain carries a substantially spherical, easily grasped, ball member.

In yet another embodiment of the invention, a pair of floor-to-ceiling poles are positioned adjacent the foot support, and substantially spherical ball members are supported by the poles.

The up-down position of the various handles may be adjusted.

It is therefore an object of this invention to support a user in a head-downward, substantially vertical position.

It is also an object of this invention to assist a user of the head-downward support to climb into that support.

It is a specific object of the invention to provide apparatus for achieving the above objects.

BRIEF DESCRIPTION OF THE DRAWINGS

Other objects will become apparent from the following description, taken in connection with the accompanying drawings, in which:

FIG. 1 is a vertical view of a first embodiment of the invention.

FIG. 2 is a view of the upper portion of FIG. 1, taken from the right in FIG. 1.

FIG. 3 is a view, partly in section, taken at 3—3 in FIG. 2.

FIG. 4 is a view, partly in section, taken at 4—4 in FIG. 1.

FIG. 5 is a sectional view taken at 5—5 in FIG. 3.

DETAILED DESCRIPTION OF THE INVENTION

Figure 6:
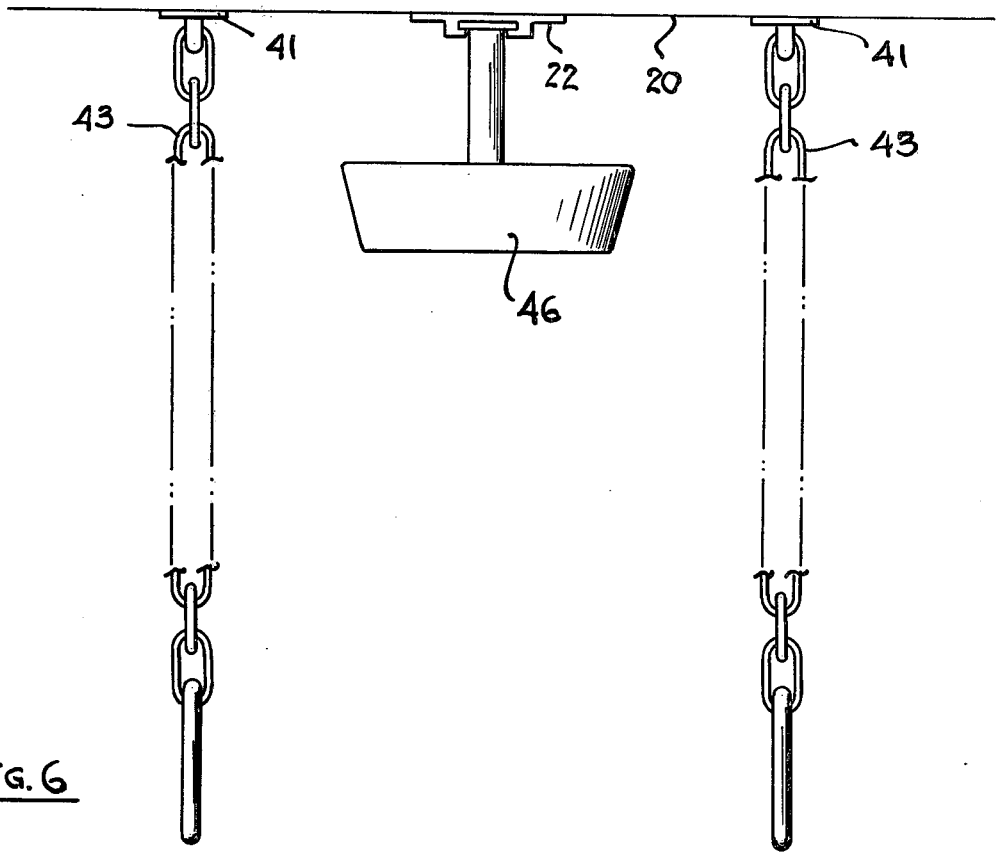
FIG. 6 is a vertical view of a second emboiment of the invention, showing rings to assist the user in mounting the foot support.

Referring to FIGS. 1 through 5, a bracket 22 is attached to the ceiling 20. The bracket 22 may be seen best in FIG. 4. A downwardly extending rod member 25 slides into the bracket 22 by a plate at its upper end. The bottom end of the rod member 25 terminates in a substantially horizontally extending handle 26.

The upper portion of the rod 25 carries a foot support member 28. As shown in FIGS. 2, 3 and 5, the foot support member comprises two individual supports 30,32, one for supporting each foot of the user. The foot support is preferably covered with a resilient material such as rubber. This coverage 34 is shown particularly in FIG. 5. The support is preferably molded integrally with a sleeve member 24 which is attached, as by shrinking, to the rod member 25. The openings 42,44 facilitate the placing of the ankle of the user into the support members 30,32.

It is within the spirit and scope of the invention that the support members 30,32 do not have a resilient covering but are made, for example, of metal or wood.

The general shape of the openings 30,32 are conical to receive the ankle of the user who then hangs head-down with his feet extending over the top of the members 30,32.

Note that the individual supports 30,32 are placed substantially symmetrically relative to a plane defined by the axis of the rod 25 and the axis of the handle 26. In this position, the user may grasp the handle 26 and swing his legs upward, through the openings 42,44 into the supports 30,32.

Figure 7:
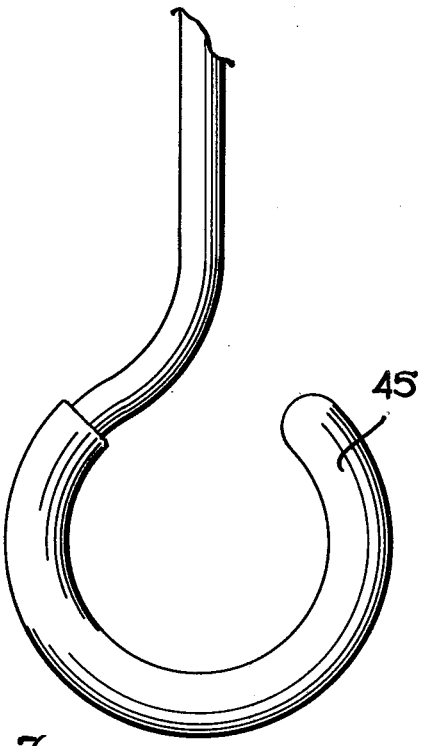
FIG. 7 is an alternative embodiment of the rings of FIG. 6.
Figure 8:
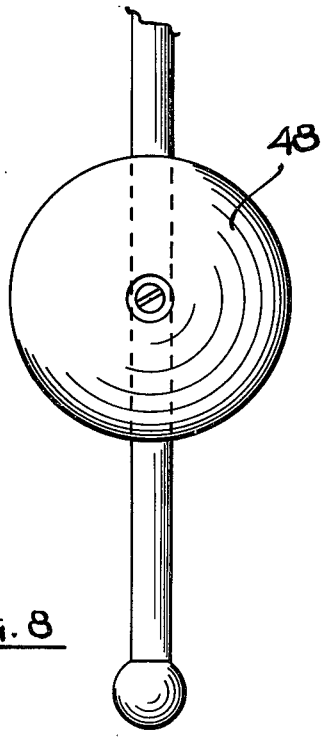
FIG. 8 is another alternative embodiment of the means for mounting the foot support.

In FIGS. 6, 7 and 8, the foot support is positioned at the bottom end of a rod which hangs from the bracket 22. The foot support 46 is substantially identical to that shown in FIGS. 1 through 5. A pair of hand rings are supported from a chain 43 which is suspended from the ceiling 20 by brackets 41. The user may then use the rings as an assist to lifting his feet into the support 46.

In FIG. 7 a hook member 45 is used in place of the rings of FIG. 6.

In FIG. 8, a substantially spherical member 48 hangs from a rod member such as rod member 25 of FIG. 1. The ball member 48 is adjustable up and down to suit the user.

Figure 9:
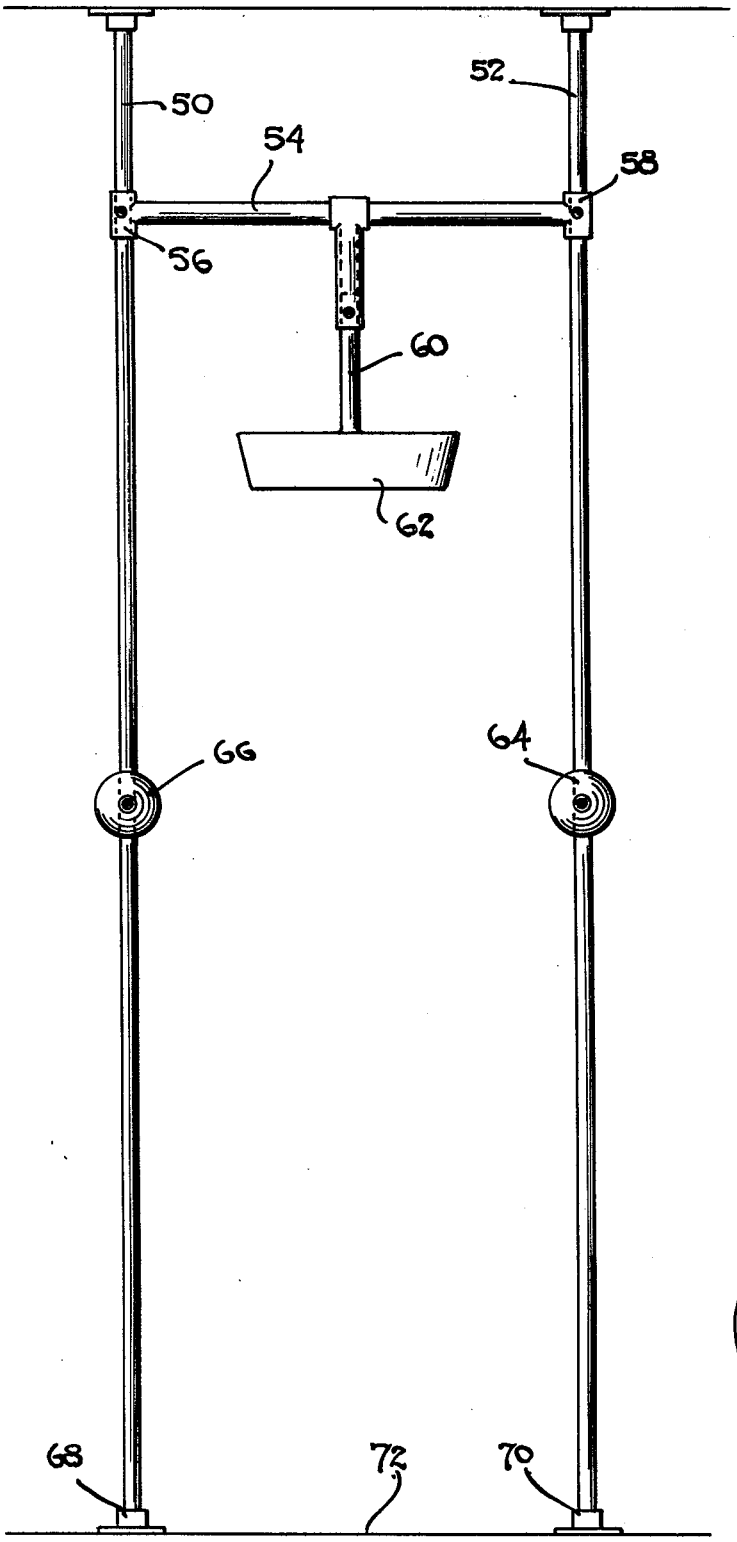
FIG. 9 teaches another alternate means for supporting the foot support and the assisting structure.

In FIG. 9, a pair of poles 50,52 are wedged between the ceiling and the floor. A crossbar 54 is attached at 56,58 to the upright poles 50,52. Attached to the center, or substantially the center of the cross bar 54 is a downwardly extending rod 60 which supports the foot support member 62. A pair of ball members, such as shown in FIG. 8, are adjusted for height on the bars or poles 50,52 at 64,66.

Figure 10:
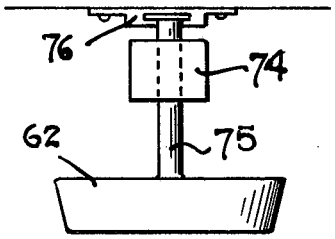
FIG. 10 and FIG. 11 show alternate means for mounting the foot support from the ceiling.
Figure 11:
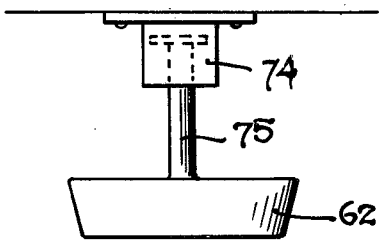

FIGS. 10 and 11 show how the downwardly extending rod 75 may be attached to a bracket 76. The locking member covers the joint between members 75,76 to lock the rod 75 in place.

Figure 12:
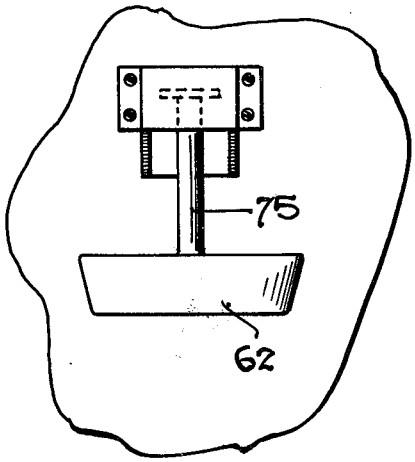
FIG. 12 teaches a means for mounting a foot support on the wall or othe vertical panel.

FIG. 12 shows how the downwardly extending member 75 may be attached to a wall bracket.

Although the apparatus of this invention has been shown in detail above, it is not intended that the invention should be limited by that description alone, but only in conjunction with the appended claims.

I claim:

1. Means for suspending a person in an upside downward position comprising:
bracket means attached to the ceiling;
a downwardly directed rod member attached to and suspended from said bracket means;
a pair of foot supports attached to said rod member with one said support upon each side of said rod member; and
means attached to said rod member below said supports for assisting the user to lift the feet above the head and into said supports.

2. The apparatus of claim 1 in which said means for lifting comprises a substantially horizontal handle extending from the bottom end of said rod means and directed normal to a plane defined by said rod means and said supports.

3. The apparatus of claim 1 in which said means for lifting comprises a ring-like member.

4. The apparatus of claim 1 in which said means for lifting comprises a hook-like member extending from the bottom end of said rod means.

5. The apparatus of claim 1 in which said means for lifting comprises a substantially spherical ball member attached to said rod below said supports.

6. Means for suspending a person in an upside downward position comprising:
a channel attached to the ceiling;
a downwardly directed rod member having a plate attached to its upper end for insertion into said channel with said rod member suspended from said plate; and
a pair of foot supports attached to said rod member with one said support upon each side of said rod member.

7. The apparatus of claim 6 and further comprising a keeper means for preventing said plate from sliding out of said channel.

8. Means for suspending a person in an upside downward position comprising:
bracket means attached to the ceiling;
a downwardly directed rod member attached to and suspended from said bracket means;
a pair of foot supports attached to said rod member with one said support upon each side of said rod member; and
a pair of ring members, suspended from the ceiling on opposite sides of said rod member to assist the user in upending the body into said foot supports.

9. Means for suspending a person in an upside downward position comprising:
a pair of upstanding pole members wedged between the ceiling and the floor;
a cross rod between said pole members;
a downwardly directed rod member attached to and suspended from said cross rod;
a pair of foot supports attached to said rod member with one said support upon each side of said rod member.

10. The apparatus of claim 9 and further comprising means attached to said pole members below said supports for assisting the user to lift the feet above the head and into said supports.

11. The apparatus of claim 10 in which said means for lifting comprises a pair of substantially spherical ball members attached to said pole members below said cross rod.

12. The apparatus of claim 9 in which said supports have an upper surface which is shaped substantially conically to accommodate the supporting of the ankle of a wearer, and a circumferentially positioned open segment extending from top to bottom of said supports to allow the ankle of a wearer to be inserted.

13. The apparatus of claim 12 in which at least the surface of said supports which contact the ankle of a wearer is padded with padding.

14. The apparatus of claim 13 in which said supports have a metal core which is covered with padding.

15. The apparatus of claim 14 in which said padding is rubber.

16. Means for suspending a person in an upside downward position comprising:
bracket means attached to the wall;
a downwardly directed rod member attached to and suspended from said bracket means;
a pair of foot supports attached to said rod member with one said support on each side of said rod member.

* * * * *